US006612680B1

(12) United States Patent
King et al.

(10) Patent No.: US 6,612,680 B1
(45) Date of Patent: Sep. 2, 2003

(54) METHOD OF IMAGING SUBSTANCE DEPLETION DETECTION FOR AN IMAGING DEVICE

(75) Inventors: David G. King, Shelbyville, KY (US); Patrick L. Kroger, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/185,954

(22) Filed: Jun. 28, 2002

(51) Int. Cl.[7] ..... B41T 29/393
(52) U.S. Cl. ..... 347/19
(58) Field of Search ..... 347/19, 14, 23, 347/16, 8, 37, 10–12, 5, 20, 6–7, 35, 65; 400/703

(56) References Cited

U.S. PATENT DOCUMENTS

| | | | |
|---|---|---|---|
| 5,170,047 | A | 12/1992 | Beauchamp et al. |
| 5,241,189 | A | 8/1993 | Vandagriff et al. |
| 5,250,956 | A | 10/1993 | Haselby et al. |
| 5,276,459 | A | 1/1994 | Danzuka et al. |
| 5,289,208 | A | 2/1994 | Haselby et al. |
| 5,297,017 | A | 3/1994 | Haselby et al. |
| 5,299,290 | A | 3/1994 | Ostermeier |
| 5,353,052 | A | 10/1994 | Suzuki et al. |
| 5,387,976 | A | 2/1995 | Lesniak |
| 5,404,202 | A | 4/1995 | Abramsohn |
| 5,448,269 | A | 9/1995 | Beauchamp et al. |
| 5,451,990 | A | 9/1995 | Sorenson et al. |
| 5,585,645 | A | 12/1996 | Goto |
| 5,600,350 | A | 2/1997 | Cobbs et al. |
| 5,748,221 | A | 5/1998 | Castelli et al. |
| 5,764,251 | A | 6/1998 | Hashimoto |
| 5,856,833 | A | 1/1999 | Elgee et al. |
| 5,936,656 | A | 8/1999 | Yamaguchi |
| 5,964,158 | A | 10/1999 | Takahashi |
| 5,975,665 | A | 11/1999 | Torigoe et al. |
| 5,975,674 | A | 11/1999 | Beauchamp et al. |
| 6,000,776 | A | 12/1999 | Suzuki et al. |
| 6,006,668 | A | 12/1999 | Rehmann |
| 6,036,298 | A | 3/2000 | Walker |
| 6,084,607 | A | 7/2000 | Matsuda |
| 6,086,274 | A | 7/2000 | Krzyminski |
| 6,106,089 | A | 8/2000 | Wen et al. |
| 6,161,914 | A | 12/2000 | Haselby |
| 6,172,690 | B1 | 1/2001 | Angulo et al. |
| 6,241,334 | B1 | 6/2001 | Haselby |
| 6,243,504 | B1 | 6/2001 | Kruppa |
| 6,286,927 | B1 | 9/2001 | Taneya et al. |
| 6,290,320 | B1 | 9/2001 | Beauchamp et al. |
| 6,310,637 | B1 | 10/2001 | Shimada et al. |
| 6,312,075 | B1 | 11/2001 | Walker |
| 6,312,082 | B1 | 11/2001 | Lund et al. |
| 6,322,192 | B1 | 11/2001 | Walker |
| 6,325,505 | B1 | 12/2001 | Walker |

*Primary Examiner*—Raquel Yvette Gordon
*Assistant Examiner*—Charles W. Stewart, Jr.
(74) *Attorney, Agent, or Firm*—Taylor & Aust, P.C.; Scott N. Barker, Esq.

(57) ABSTRACT

A method of imaging substance depletion detection in an imaging device. The method includes the steps of identifying a theoretical coverage of an imaging substance for a first area of a sheet of print media; determining an actual coverage of the imaging substance for the first area of the sheet of print media; comparing the theoretical coverage with the actual coverage; and determining whether a depletion of the imaging substance has occurred based on a result of the comparing step.

22 Claims, 4 Drawing Sheets

METHOD OF IMAGING SUBSTANCE DEPLETION DETECTION FOR AN IMAGING DEVICE

BACKGROUND OF THE INVENTION

1. Field of the Invention

The present invention relates to an imaging device, and, more particularly, to a method of imaging substance depletion detection in an imaging device.

2. Description of the Related Art

A typical imaging device, such as an ink jet printer or electrophotographic (EP) printer, forms an image on a print medium by extracting an imaging substance, such as ink or toner, from an imaging substance reservoir and depositing the imaging substance on a surface of the print medium.

For example, an ink jet printer forms an image on a print medium by selectively ejecting ink from a plurality of ink jetting nozzles of a printhead to form a pattern of ink dots on the print medium. A color printhead may include a plurality of nozzle arrays, such as a cyan array, a magenta array, and a yellow array, arranged as a longitudinal column of nozzle arrays. A monochrome printhead may include a single monochrome nozzle array arranged as a longitudinal column. During ink jet printing, ink is supplied to the printhead from an ink reservoir, which contains an ink supply. The ink reservoir may be formed with the printhead as an integral unit, as in the case if an ink jet cartridge, or may be located remote from the printhead and fluidly coupled to the printhead via one or more ink carrying tubes. As printing occurs, ink is removed from the ink supply.

It is known in the art to attempt to detect when the ink supply is depleted. Many such attempts include the use of optical or magnetic sensors that are used to determine low levels of ink prior to exhaustion of the ink supply. However, implementation of such sensors can be difficult, and add cost to the printing system.

What is needed in the art is a method of imaging substance depletion detection in an imaging device that addresses the problems identified above.

SUMMARY OF THE INVENTION

In one form thereof, the present invention relates to a method of imaging substance depletion detection in an imaging device. The method includes the steps of identifying a theoretical coverage of an imaging substance for a first area of a sheet of print media; determining an actual coverage of the imaging substance for the first area of the sheet of print media; comparing the theoretical coverage with the actual coverage; and determining whether a depletion of the imaging substance has occurred based on a result of the comparing step.

In another form thereof, the present invention relates to an imaging system. The imaging system includes a computer. The computer includes driver software for calculating a theoretical coverage of an imaging substance for a first area of a sheet of print media. An imaging device is capable of receiving information from the computer. The imaging device is capable of performing the steps of determining an actual coverage of the imaging substance for the first area of the sheet of print media; comparing the theoretical coverage with the actual coverage; and determining whether a depletion of the imaging substance has occurred based on a result of the comparing step.

An advantage of certain embodiments of the present invention could include relatively easy implementation in any imaging device using a simple sensor that senses the presence of imaging substance on the print medium.

Another advantage of certain embodiments of the present invention is that, in an imaging device having a preexisting sensor that senses the presence of imaging substance on the print medium, for example, an embodiment of the present invention can be implemented without any additional hardware costs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one exemplary embodiment of the invention, in one form, and such exemplifications are not to be construed as limiting the scope of the invention in any manner.

DETAILED DESCRIPTION OF THE INVENTION

Figure 1:
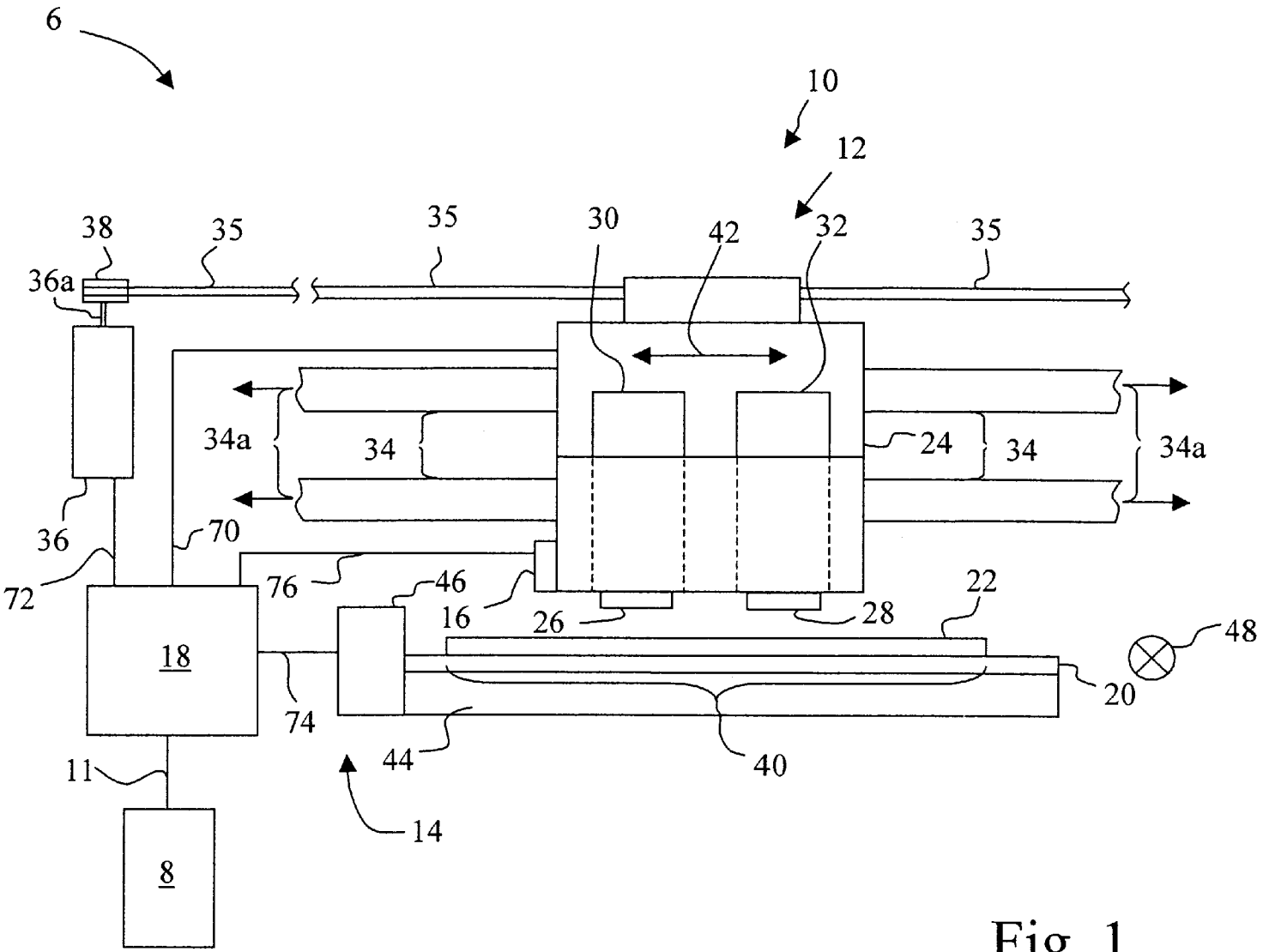
FIG. 1 is a diagrammatic representation of an imaging system embodying the present invention.

Referring now to the drawings and particularly to FIG. 1, there is shown an exemplary imaging system 6 embodying the present invention. Imaging system 6 includes a computer 8 and an imaging device in the form of an ink jet printer 10. Other embodiments of the present invention might not include a computer (e.g. stand-alone imaging devices).

Computer 8 is communicatively coupled to ink jet printer 10 via a communications link 11. Communications link 11 may be, for example, a direct (wired or wireless) electrical or optical connection, or a network connection. Computer 8 is typical of that known in the art, and includes a display, an input device, e.g., a keyboard, a processor, and associated memory.

Resident in the memory of computer 8 is printer driver software. The printer driver software can place print data and print commands in a format that can be recognized by ink jet printer 10. In addition, the printer driver software can include program instructions that permit computer 8 to calculate, based on print data, a theoretical coverage of imaging substance, e.g., ink, for a given area, such as a print swath. The format can be, for example, a data packet including print data and printing commands for the given area, and including a print header that includes the theoretical coverage of ink for the given area.

Ink jet printer 10 includes a printhead carrier system 12, a feed roller unit 14, a printhead alignment sensor 16, a controller 18 and a mid-frame 20.

Printhead carrier system 12 includes a printhead carrier 24 for carrying printhead alignment sensor 16, a color printhead 26 and a black printhead 28. A color ink reservoir 30 is provided in fluid communication with color printhead 26, and a black ink reservoir 32 is provided in fluid communication with black printhead 28. Printhead carrier system 12 and printheads 26, 28 may be configured for unidirectional printing or bi-directional printing.

Printhead carrier 24 is guided by a pair of guide rods 34. The axes 34*a* of guide rods 34 define a bi-directional scanning path for printhead carrier 24, and thus, for convenience the bi-directional scanning path will be referred to as bi-directional scanning path 34*a*. Printhead carrier 24 is connected to a carrier transport belt 35 that is driven by a carrier motor 36 via driven pulley 38 to transport printhead carrier 24 in a reciprocating manner along guide rods 34. Carrier motor 36 can be, for example, a direct current (DC) motor or a stepper motor. Carrier motor 36 has a rotating carrier motor shaft 36*a* that is attached to carrier pulley 38.

The reciprocation of printhead carrier 24 transports ink jet printheads 26, 28 across a sheet of print media 22, such as paper, along bi-directional scanning path 34*a* to define a print zone 40 of printer 10. This reciprocation occurs in a main scan direction 42 that is parallel with bi-directional scanning path 34*a*, and is also commonly referred to as the horizontal direction. During each scan of printhead carrier 24, the sheet of print media 22 is held stationary by feed roller unit 14.

Feed roller unit 14 includes an index roller 44 and corresponding index pinch rollers (not shown). Index roller 44 is driven by a drive unit 46. The pinch rollers apply a biasing force to hold the sheet of print media 22 in contact with respective driven index roller 44. Drive unit 46 includes a drive source, such as a stepper motor, and an associated drive mechanism, such as a gear train or belt/pulley arrangement.

Controller 18 is electrically connected to printheads 26 and 28 via a printhead interface cable 70. Controller 18 is electrically connected to carrier motor 36 via interface cable 72. Controller 18 is electrically connected to drive unit 46 via interface cable 74. Controller 18 is electrically connected to printhead alignment sensor 16 via interface cable 76.

Controller 18 includes a microprocessor having memory, such as an associated random access memory (RAM) and read only memory (ROM). Controller 18 executes program instructions to effect the printing of an image on the sheet of print media 22, such as coated paper, plain paper, photo paper and transparency. In addition, controller 18 executes instructions to conduct printhead alignment based on information received from printhead alignment sensor 16. Furthermore, controller 18 can execute instructions to perform imaging substance depletion detection in accordance with the present invention.

Printhead alignment sensor 16 may be, for example, a unitary optical sensor including a light source, such as a light emitting diode (LED), and a reflectance detector, such as a phototransistor. For example, the reflectance detector can be located on the same side of a media as the light source. The operation of such sensors is well known in the art, and thus, will only briefly be discussed herein. For example, the LED of printhead alignment sensor 16 directs light at a predefined angle onto a material surface of the sheet of print media 22 and an amount of light reflected from the surface is received by the reflectance detector of printhead alignment sensor 16. From the received amount of reflected light, the reflectance detector generates an intensity signal that is indicative of the presence or absence of an imaging substance, i.e., ink, on the surface of the sheet of print media 22.

During a printhead alignment operation, an alignment pattern can be printed on the sheet of print media 22 by the printhead, e.g., one of printheads 26 and 28, to be aligned. Printhead alignment sensor 16 can be scanned across the printed alignment pattern to sense the presence or absence of the printed alignment pattern, and in turn, send corresponding alignment signals via interface cable 76 to controller 18. From the alignment signals, controller 18 can make adjustments to compensate for any printhead misalignment, such as for example, printhead skew.

During normal printing, computer 8 might supply to ink jet printer 10 a data packet for a swath of print data. A swath is an area of print coverage along bi-directional scanning path 34*a* having a height of the printhead. Each data packet can include a print header that identifies the swath to be printed. The print header can include a theoretical coverage of ink for the swath, as calculated by, for example, the printer driver software executed on computer 8.

Controller 18 of ink jet printer 10 can receive the data packet and extract therefrom the print header, print commands and print data. Controller 18 can control index roller 44 via drive unit 46 to incrementally advance print medium sheet 22 in a sheet feed direction 48, toward and into a print zone 40 across mid-frame 20. At each increment of advancement of print medium sheet 22, controller 18 can control the ink ejections of printheads 26 and/or 28, and control the reciprocation of printhead carrier 24 via carrier motor 36. As shown in FIG. 1, sheet feed direction 48 is depicted as an X within a circle to indicate that the sheet feed direction is in a direction perpendicular to the plane of FIG. 1, toward the reader. As printhead carrier 24 reciprocates across the sheet of print media 22, so can printhead alignment sensor 16. In accordance with one embodiment of the present invention, printhead alignment sensor 16 is further used during normal printing to scan a printed swath of an image formed on the sheet of print media 22, and generate an intensity signal that varies in magnitude as sensor 16 transitions from printed to non-printed portions of the printed swath. The intensity signal can be supplied to controller 18 via interface cable 76.

Figure 2:
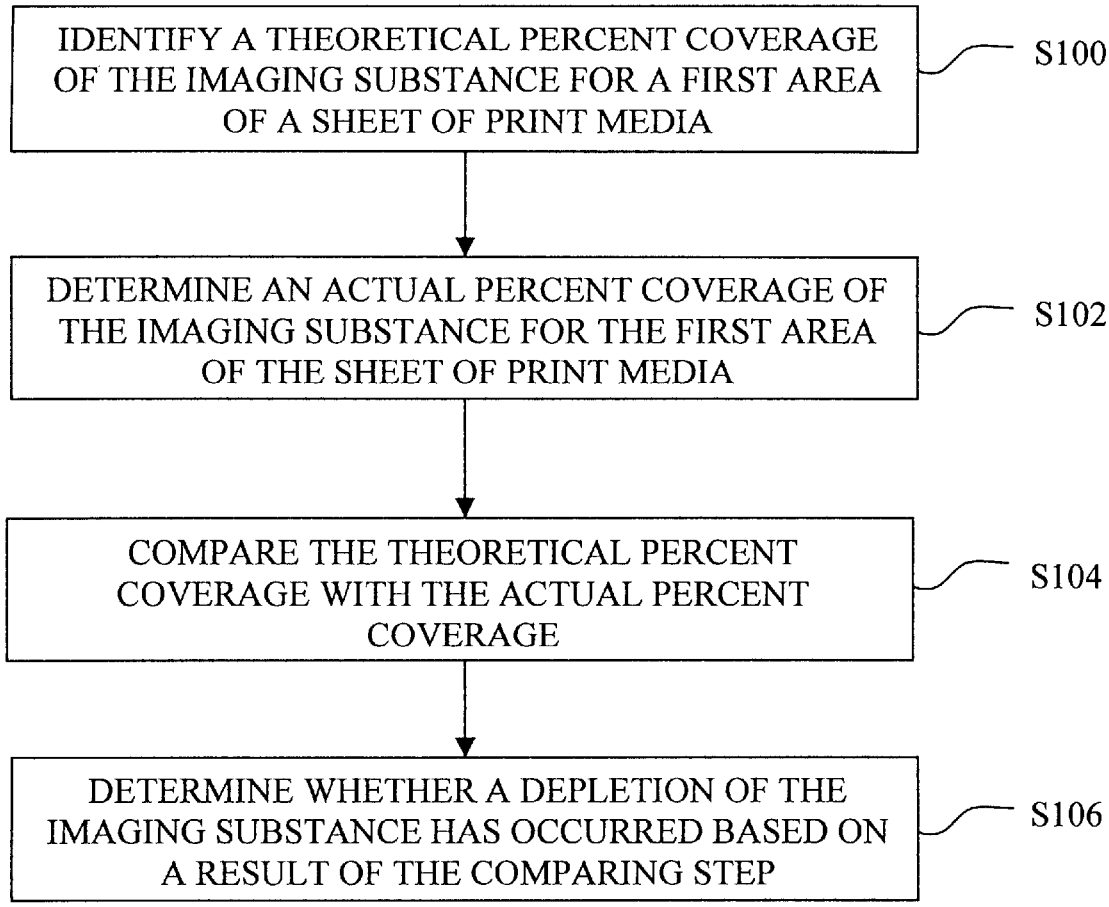
FIG. 2 is a flowchart of a method of the present invention.

FIG. 2 is a general flowchart of a method of the present invention.

Figure 3:
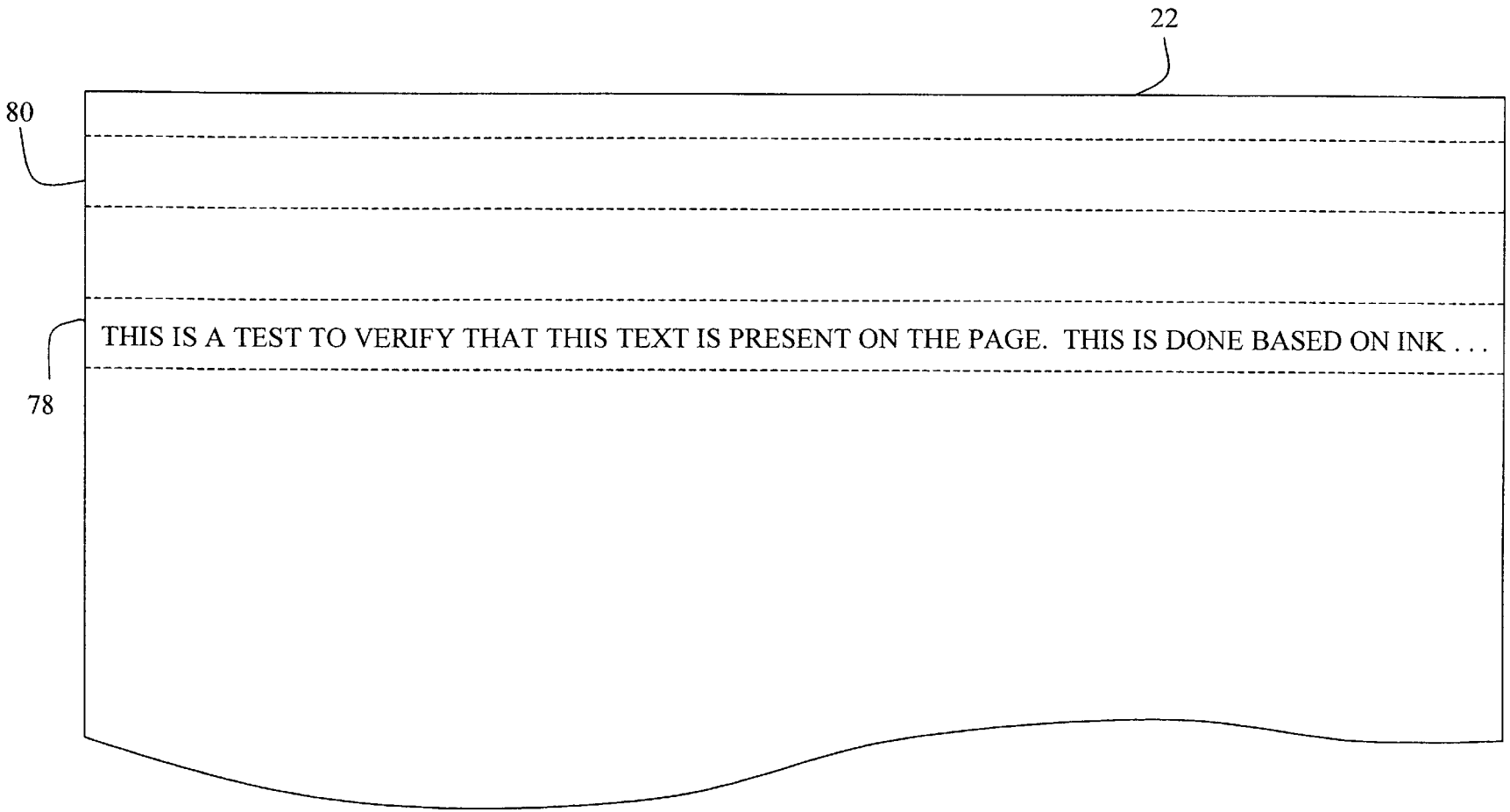
FIG. 3 is a top view of a sheet of print media including a first area and a second area.

At step S100, the process determines a theoretical coverage (e.g. percent) of the imaging substance, e.g., ink or toner, for a first area 78 on the sheet of print media 22 (see FIG. 3). As stated above, driver software could include program instructions that, when executed by computer 8, calculate a theoretical percent coverage for the first area based on print data. First area 78 may be, for example, a print swath. The first area 78 can be considered representative of the printed page on the sheet of print media 22, or alternatively, representative of a print job.

At step S102, the process determines an actual coverage (e.g. percent) of the imaging substance on first area 78 of the sheet of print media considered in step S100. As an example of this determination, and in no particular order, sensor 16 could be scanned over first area 78, such as a print swath including a printed image, of the sheet of print media 22 under consideration and supply a first intensity signal to controller 18, which in turn can process the first intensity signal to acquire a first intensity measurement. Also, sensor 16 can scan over the sheet of print media 22 in a second area 80 where no imaging substance is present, such as a margin, and supply a second intensity signal to controller 18, which in turn can process the second intensity signal to acquire a second intensity measurement. The second intensity measurement can serve as a baseline for calculating the actual percent coverage. Controller 18 can execute program instructions to calculate the actual percent coverage of the imaging substance for first area 78 of the sheet of print media 22 based on the first intensity measurement and the second intensity measurement.

Figure 4:
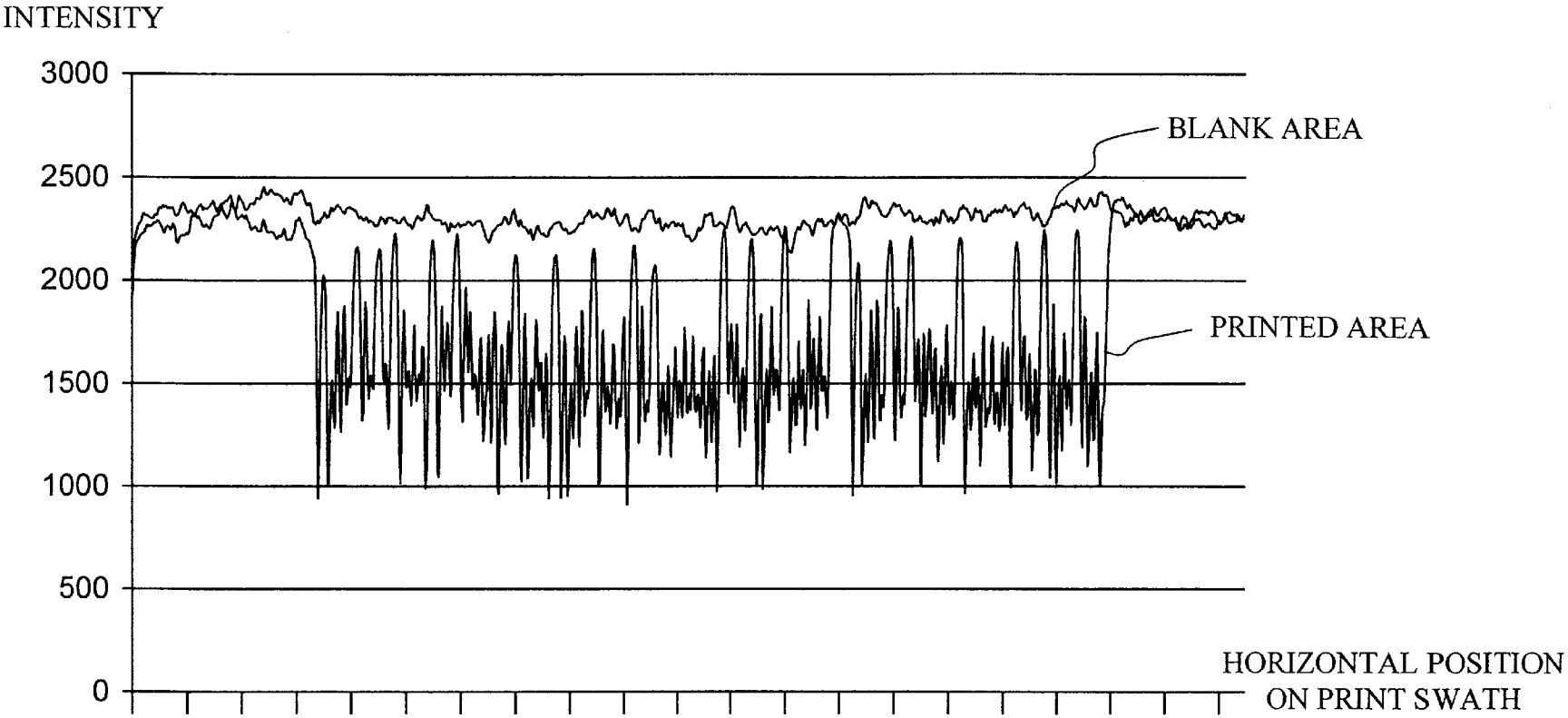
FIG. 4 shows a graph of intensity values measured on a blank area of a sheet of print media and a graph of intensity values measured on a print swath of a sheet of print media including an image.

Step S102 may be better understood by considering the following example in relation to FIGS. 3 and 4. FIG. 4 shows two graphs, each plotting intensity versus horizontal position on the print swath. The upper graph is that of the reflected light intensity sensed by a sensor, such as sensor 16, as the sensor is scanned over a blank area, e.g., second area 80 discussed above, such as a top margin of media sheet 22. As shown, the blank area has an intensity range of between about 2200 and about 2450. The lower graph shows the intensity sensed by the sensor, e.g., sensor 16, as the sensor is scanned over a printed area, e.g., first area 78 discussed above, such as a print swath, of the sheet of print media 22 that includes a text message. In the lower graph, the actual text message is, as shown in FIG. 3, "THIS IS A TEST TO VERIFY THAT THIS TEXT IS PRESENT ON THE PAGE. THIS IS DONE BASED ON INK . . . "

As shown, the text message has an intensity range of between about 950 and about 2200. Each peak corresponds to a separation between the characters of the printed text, and the widest peak corresponds to the space between the two sentences. The first intensity signal corresponding to a scan of printhead alignment sensor 16 over the printed area 78, i.e., the print swath including the text area, is sampled multiple times, and in this case, a sum of the printed area 78 samples yields 1,836,678. Likewise, the second intensity signal corresponding to a scan of sensor 16 over the blank area 80 is sampled multiple times, and in this case, a sum of the blank area 80 samples yields 2,360,525. Thus, the actual percent coverage can be calculated by taking the quantity 2,360,525 minus 1,836,678 divided by 2,360,525 times 100, which is about 22 percent.

At step S104, the process compares the theoretical percent coverage with the actual percent coverage. The comparison of step S104 can be made, for example, by controller 18.

At step S106, the process determines whether a depletion of the imaging substance has occurred based on a result of the comparing step. For example, controller 18 can compare the actual percent coverage of ink in first area 78 with the theoretical percent coverage of first area 78, and from this comparison can form a judgment as to whether the ink supply has been depleted. The user can be notified of the depletion of the ink supply, such as for example, by the display of a text message at computer 8.

The following is pseudo code representing an implementation of one embodiment of the present invention for an ink jet printer. The pseudo code may be executed, in whole or in part, in controller 18 of ink jet printer 10. Further, the pseudo code implements the process generally described above with respect to the flowchart of FIG. 2.

```
IF the theoretical percent coverage (TPC)>TCP threshold
    THEN scan the print swath with sensor 16, and perform
    the actual percent coverage calculation;
IF the actual percent coverage (APC)>scaling factor
    (SF)×TCP, THEN INK IS PRESENT;
ELSE
    NOT ENOUGH INK, and
    notify user of ink depletion;
END IF
```

In the pseudo code above, the theoretical percent coverage (TPC) threshold is established, such as for example, 20 percent. As such, in that embodiment the theoretical percent coverage of first area 78, e.g., a print swath, will have to be greater than the TPC threshold before the process will be completed. In other words, if the TPC threshold is greater than the theoretical percent coverage, then the actual percent coverage for first area 78 will be considered to be inadequate to yield a reliable indication of ink depletion, and the determination of an actual percent coverage will not be performed for that particular area, e.g., for that particular print swath.

Also, in the pseudo code above, the scaling factor SF is established so that for purposes of the calculation, a value less than the full amount of the theoretical percent coverage is used, thereby compensating for variability of the actual scanned image of first area 78 as represented by the corresponding printed image in the print swath, and in turn, so as to not create false alarms. Scaling factor SF can be, for example, 0.75.

While this invention has been described with an exemplary design, the present invention can be further modified within the spirit and scope of this disclosure. For example, in curtain embodiments, a controller might calculate a theoretical coverage, and/or driver(s) might determine an actual coverage, compare the theoretical coverage with the actual coverage, and/or determine whether depletion has occurred. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of imaging substance depletion detection in an imaging device, comprising the steps of:

identifying a theoretical coverage of an imaging substance for a first area of a sheet of print media;

determining an actual coverage of said imaging substance for said first area of said sheet of print media based on a measurement of the first area;

comparing said theoretical coverage with said actual coverage; and determining whether a depletion of said imaging substance has occurred based on a result of said comparing step.

2. The method of claim 1, wherein said theoretical coverage is calculated based on print data.

3. The method of claim 2, wherein said theoretical coverage is supplied to said imaging device in a print header of a data packet, said data packet including said print data.

4. The method of claim 2, wherein said theoretical coverage is calculated by driver software executed on a computer capable of sending information to said imaging device.

5. The method of claim 1, wherein said actual coverage is measured using an optical sensor.

6. The method of claim 1, wherein the step of determining said actual coverage comprises the steps of:

determining a first intensity measurement of said first area of said sheet of print media where said imaging substance is present;

determining a second intensity measurement of a second area of said sheet of print media where no imaging substance is present; and calculating said actual coverage of said imaging substance for said first area of said sheet of print media based on said first intensity measurement and said second intensity measurement.

7. The method of claim 1, further comprising the step of establishing a theoretical coverage threshold, wherein if said threshold is greater than said theoretical coverage, then said actual coverage is considered to be inadequate to yield a reliable indication of said depletion of said imaging substance.

8. The method of claim 1, wherein said theoretical coverage is scaled by a scaling factor.

9. The method of claim 8, wherein said scaling factor is established to reduce a value representing said theoretical coverage to compensate for variability of actual scanned image data as represented by a corresponding printed image in said first area.

10. The method of claim 1, wherein said imaging substance is one of ink and toner.

11. The method of claim 1, further comprising the step of notifying a user of said depletion of said imaging substance.

12. The method of claim 1, wherein the theoretical coverage is a theoretical percentage coverage and the actual coverage is an actual percentage coverage.

13. An imaging system, comprising:

a computer, said computer including driver software for calculating a theoretical coverage of an imaging substance for a first area of a sheet of print media; an imaging device capable of receiving information from said computer, said imaging device being capable of performing the steps of:

determining an actual coverage of said imaging substance for said first area of said sheet of print media based on a measurement of the first area;

comparing said theoretical coverage with said actual coverage; and determining whether a depletion of said imaging substance has occurred based on a result of said comparing step.

14. The imaging system of claim 13, wherein said theoretical coverage is calculated based on print data.

15. The imaging system of claim 14, wherein said theoretical coverage is supplied by said computer to said imaging device in a print header of a data packet, said data packet including said print data.

16. The imaging system of claim 13, wherein said actual coverage is measured using an optical sensor.

17. The imaging system of claim 13, wherein the step of determining said actual coverage comprises the steps of:

determining a first intensity measurement of said first area of said sheet of print media where said imaging substance is present;

determining a second intensity measurement of a second area of said sheet of print media where no imaging substance is present; and calculating said actual coverage of said imaging substance for said first area of said sheet of print media based on said first intensity measurement and said second intensity measurement.

18. The imaging system of claim 13, further comprising the step of establishing a theoretical coverage threshold, wherein if said threshold is greater than said theoretical coverage, then said actual coverage is considered to be inadequate to yield a reliable indication of said depletion of said imaging substance.

19. The imaging system of claim 13, wherein said theoretical coverage is scaled by a scaling factor.

20. The imaging system of claim 19, wherein said scaling factor is established to reduce a value representing said theoretical coverage to compensate for the variability of actual scanned image data as represented by a corresponding printed image in said first area.

21. The imaging system of claim 13, wherein said imaging substance is one of ink and toner.

22. The imaging system of claim 13, further comprising the step of notifying a user of said depletion of said imaging substance.

* * * * *